United States Patent [19]

Chow et al.

[11] Patent Number: 4,750,674

[45] Date of Patent: Jun. 14, 1988

[54] ASPIRATION-TYPE SPRAYER

[75] Inventors: Ho Chow, Cliffside Park; Joseph E. Testa, Woodcliff Lake, both of N.J.

[73] Assignee: Hunter-Melnor, Inc., Memphis, Tenn.

[21] Appl. No.: 901,311

[22] Filed: Aug. 28, 1986

[51] Int. Cl.[4] ..... B05B 7/30

[52] U.S. Cl. ..... 239/318; 239/390; 239/396

[58] Field of Search ..... 239/314, 318, 311, 310, 239/316, 315, 521, 522, 581.1, 407, 340, 341, 354, 369, 390, 396, 428.5, 600; 222/630

[56] References Cited

U.S. PATENT DOCUMENTS

| | | | |
|---|---|---|---|
| 2,719,704 | 10/1955 | Anderson et al. | 239/318 X |
| 2,877,837 | 3/1959 | Alger | 239/522 X |
| 2,926,857 | 3/1960 | Snyder | 239/318 X |
| 2,948,480 | 8/1960 | Budwig | 239/314 X |
| 3,032,274 | 5/1962 | Budwig | 239/318 X |
| 3,940,069 | 2/1976 | Gunzel, Jr. et al. | 239/318 |
| 4,204,614 | 5/1980 | Reeve | 239/600 X |
| 4,349,157 | 9/1982 | Beiswenger et al. | 239/318 X |
| 4,475,689 | 10/1984 | Hauger et al. | 239/318 |

FOREIGN PATENT DOCUMENTS

| | | | |
|---|---|---|---|
| 2446533 | 4/1975 | Fed. Rep. of Germany | 239/318 |

*Primary Examiner*—Andres Kashnikow

*Attorney, Agent, or Firm*—James & Franklin

[57] ABSTRACT

An aspiration sprayer comprises a head which is permanently attached to the container in which the additive material is received and which is movable between a first position in which the interior of the container is sealed and a second position in which the interior of the container is unsealed and aspiration occurs, the making of seals and appropriate fluid connecitions being accomplished by a plurality of sealed cups moved by the head. Safety means are provided to tend to retain the head in its container-sealing position. An aspiration opening is accessed by means of a nozzle which is snap-engaged with the head, and the carrier fluid after it leaves the nozzle is guided by means of flanges on the head so located and oriented as to produce a long-distance jet output. A cover protects the parts from accumulation of foreign matter.

28 Claims, 6 Drawing Sheets

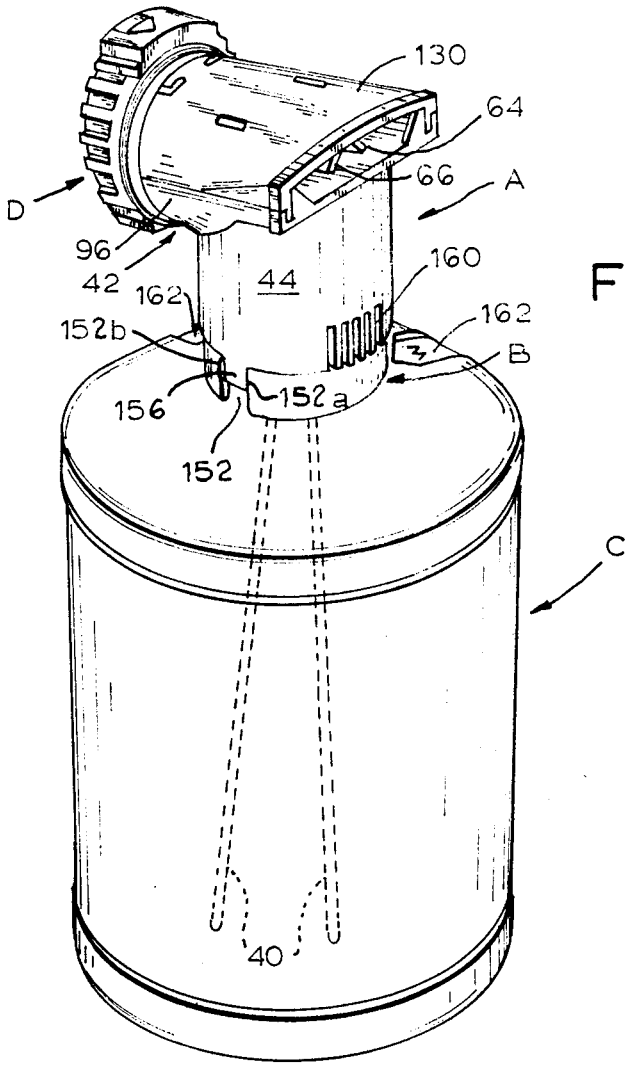
FIG. 1
FIG. 8
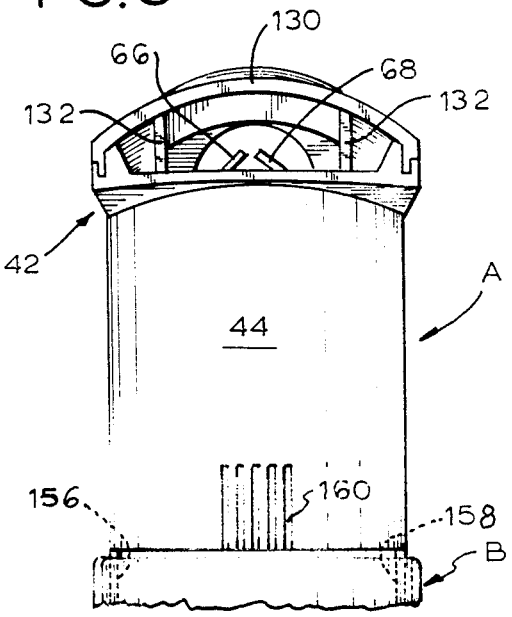
FIG. 9
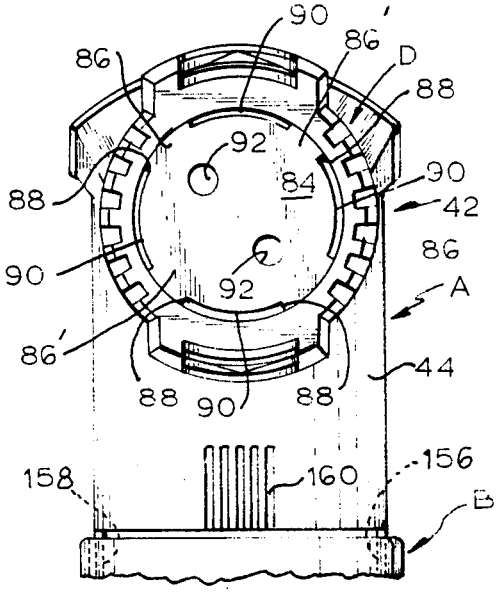

ASPIRATION-TYPE SPRAYER

The present invention relates to the construction of an aspiration-type sprayer so as to facilitate assembly, reduce cost, and in particular to provide effective control of the presence or absence and nature of the aspiration with a maximum of safety and convenience.

Aspiration-type sprayers are commonly used to mix relatively small quantities of an additive material with relatively large quantities of a carrier fluid such as water, the mixing being effected by causing the carrier fluid to pass rapidly over an opening which communicates with the interior of a container carrying the additive material and produce a suction effect which sucks the additive material into the stream of carrier fluid. This type of sprayer is frequently used in an agricultural environment, to apply chemicals of various types (e.g. pesticides) to bushes and trees. The present invention will be here disclosed as specially designed for such a use, with the additive material generally referred to as an insecticide, but it will be appreciated that it is not limited to such applications, and that the additive material need not be an insecticide.

Quite frequently, particularly in agricultural applications, the additive substance to be sprayed is dangerous to humans, certainly if taken internally and frequently if applied externally. Many insecticides, commonly sprayed by homeowners, are of that character, and hence these substances are necessarily stored in household environments where they are exposed to children and thus constitute a very serious potential hazard.

Aspirating sprayers of the type under discussion have in the past been so constructed as to be attachable to and detachable from the containers for the insecticide or other material to be applied, so that when one container of insecticide has been emptied the sprayer can be removed and attached to another container. This is economically advantageous, but it also means that the containers of insecticide are of the openable type both before and after the sprayer has been put in place thereon. Thus the containers themselves, while on the household shelf waiting to be used, are hazardous, since a child may gain access thereto, remove the cap or sprayer, as the case may be, and thus be exposed to the insecticide.

In accordance with the present invention, by way of contrast, the sprayer is permanently attached to the container for insecticide or the like, and is so associated therewith that it effectively seals the contents of the container, preventing spilling thereof or other access thereto by children or careless handlers, while at the same time enabling effective aspiration-type spraying to take place when desired. Since the sprayer and the container form a permanent combination the sprayer cannot be reused once the contents of the container have been exhausted—the container and the attached sprayer are simply discarded together. From a practical point of view this means that the sprayer must be sufficiently inexpensive to manufacture and assemble so that its permanent association with the container will be economically feasible.

These two requirements—efficient and reliable sealing and aspiration and ready selection between them on the one hand and low cost on the other hand—would appear to be antithetical, but by virtue of the construction of the present invention those two requirements have been satisfactorily merged.

Because of the potentially dangerous nature of the insecticides or other substances to be applied it is desirable for the person doing the spraying to keep his distance from the tree or bush being sprayed, and this requires that the sprayed mixture of carrier fluid and insecticide can be projected from the spraying device for an appreciable distance. This has proved to present a very significant problem in connection with a garden-type sprayer such as is here specifically disclosed, especially when the sprayer is of the so-called open-gap type where the aspiration opening is in effect exposed to atmospheric pressure. In order to meet the economics requirements of the container-attached sprayer use of the relatively inexpensive open-gap sprayer type was indicated, but ordinarily open-gap type sprayers do not have sufficient throw distance. However, by providing suitably positioned and oriented guiding flanges adjacent the aspiration opening between which the carrier fluid is caused to flow, much greater throw distances have been achieved than were formerly attainable with open-gap aspiration sprayers.

One feature of the construction here disclosed which plays a large part in attaining the cost, safety and operational features that are achieved is the mounting of the sprayer on the container, permanently as has been stated, so that the sprayer itself may be rotated relative to the container between operative positions in one of which the container is sealed and carrier fluid alone exits from the sprayer and in another of which the container is unsealed, aspiration occurs and the carrier fluid mixed with container contents exists from the sprayer. (Indeed, in the embodiment here specifically disclosed there are two different aspiration positions for two different mixing ratios.) The movement of the sprayer carries with it a plurality of cups which sealingly engage and move over a wall in which there are a pair of openings to the interior of the container. In the non-aspiration operating position cups engage and seal both of those openings, thus effectively closing the container and preventing escape of the contents thereof. In the aspiration position no cup engages one of those openings, which thus permits atmospheric pressure to be applied to the interior of the container, while a special cup, communicating with the aspiration opening over which the carrier fluid passes, sealingly engages the second opening, thus providing fluid communication between the interior of the container and the aspiration opening and permitting the contents of the container to be sucked up into the carrier fluid as the carrier fluid passes over the aspiration opening. The design lends itself to providing different aspiration rates, associated respectively with different size openings communicating between the aspiration opening and the interior of the container, the rotational position of that special cup determining which aspiration rate will be operative.

As an important safety feature, movement of the sprayer from its non-aspiration or sealing position to an aspiration position is strongly resisted by means requiring a relatively sophisticated and non-obvious type of manipulation to enable such movement, thus effectively rendering the sprayer child-proof from a safety point of view.

Although, for the reasons set forth above, an open-gap type of aspiration is here used, that type of sprayer has the disadvantage that precisely because it is an open-gap device the gap is exposed and dirt, dust and other foreign materials may accumulate in and wholly or partially block the gap. To avoid this problem, and also to protect the parts from physical damage and to give the sprayer an attractive, clean and uncluttered look, a cover is provided which simply snaps into place and which protects the parts as indicated without inhibiting the open-gap aspiration action.

To the accomplishment of the above, and to such other objects as may hereinafter appear, the present invention relates to the construction of an aspiration-type sprayer designed to be permanently attached to a container for the additive substance to be sprayed, as defined in the appended claims and as described in this specification, taken together with the accompanying drawings, in which FIG. 1 is a three-quarter perspective view of the sprayer of the present invention in position on a container;

Figure 2:
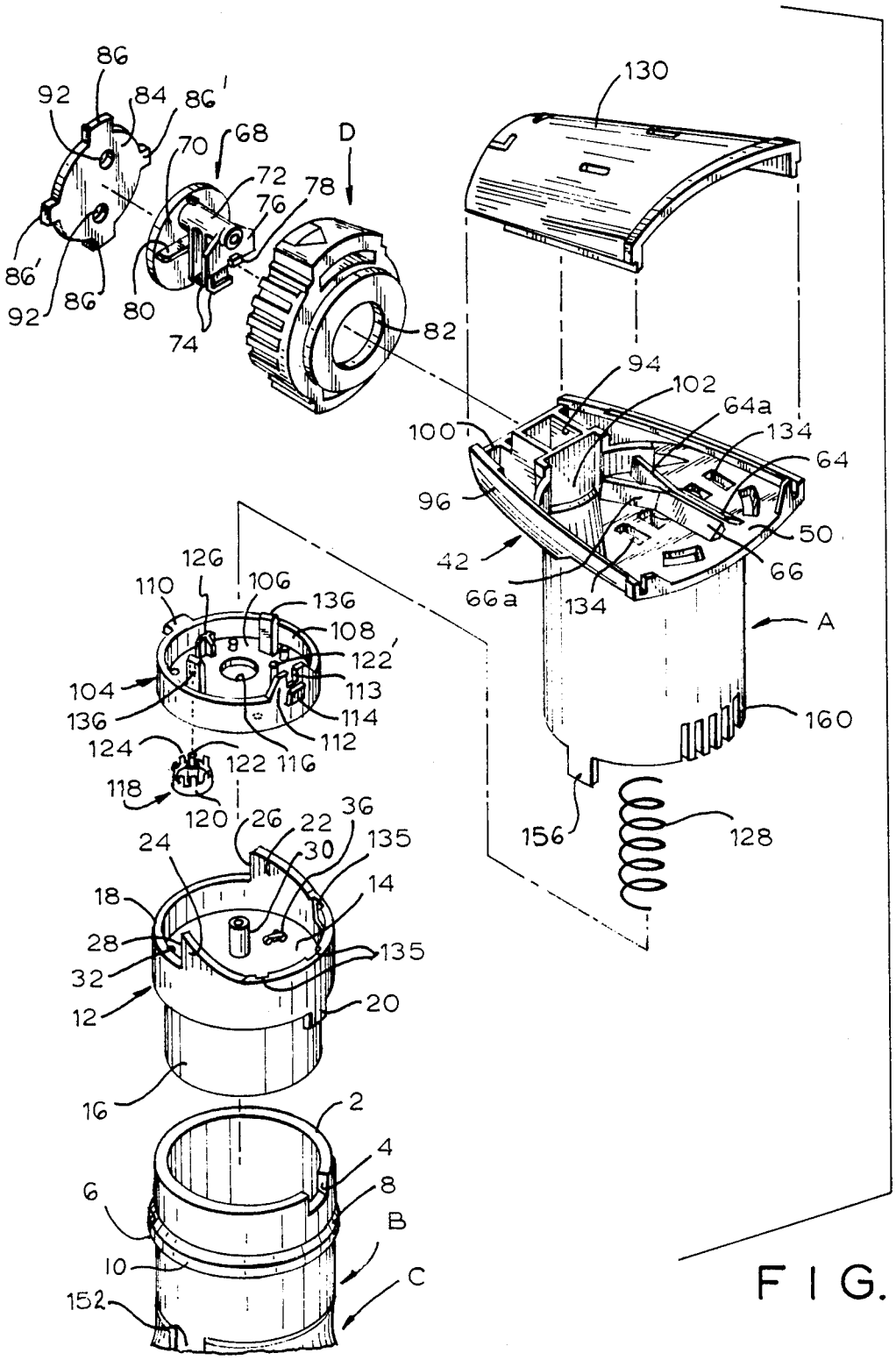
FIG. 2 is a three-quarter perspective exploded view showing the various parts of the sprayer and the container neck on which they are to be mounted.
Figure 3:
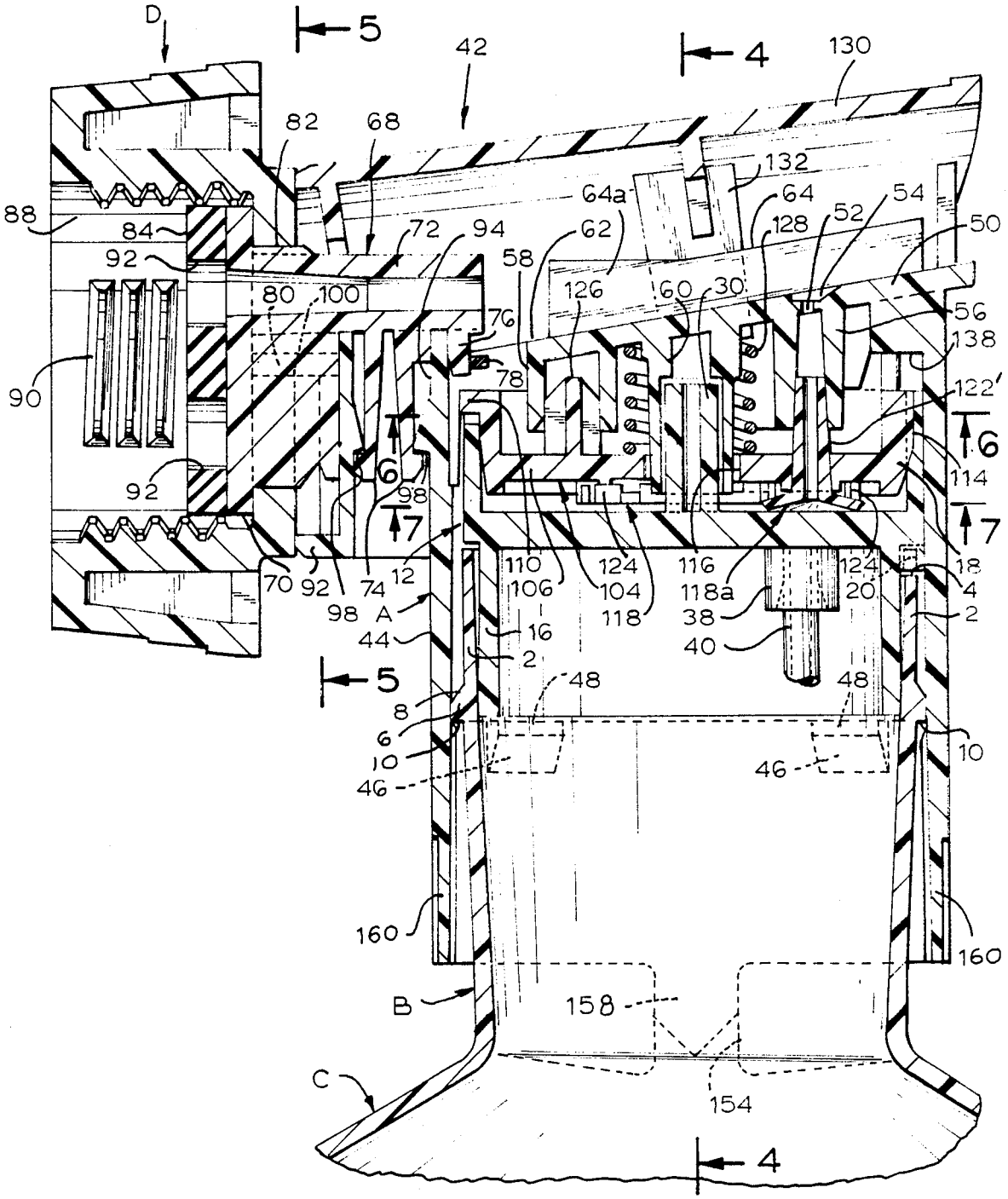
FIG. 3 is a side elevational view, on an enlarged scale, of the container with the sprayer mounted thereon, the sprayer being cross-sectioned along a central vertical plane.
Figure 4:
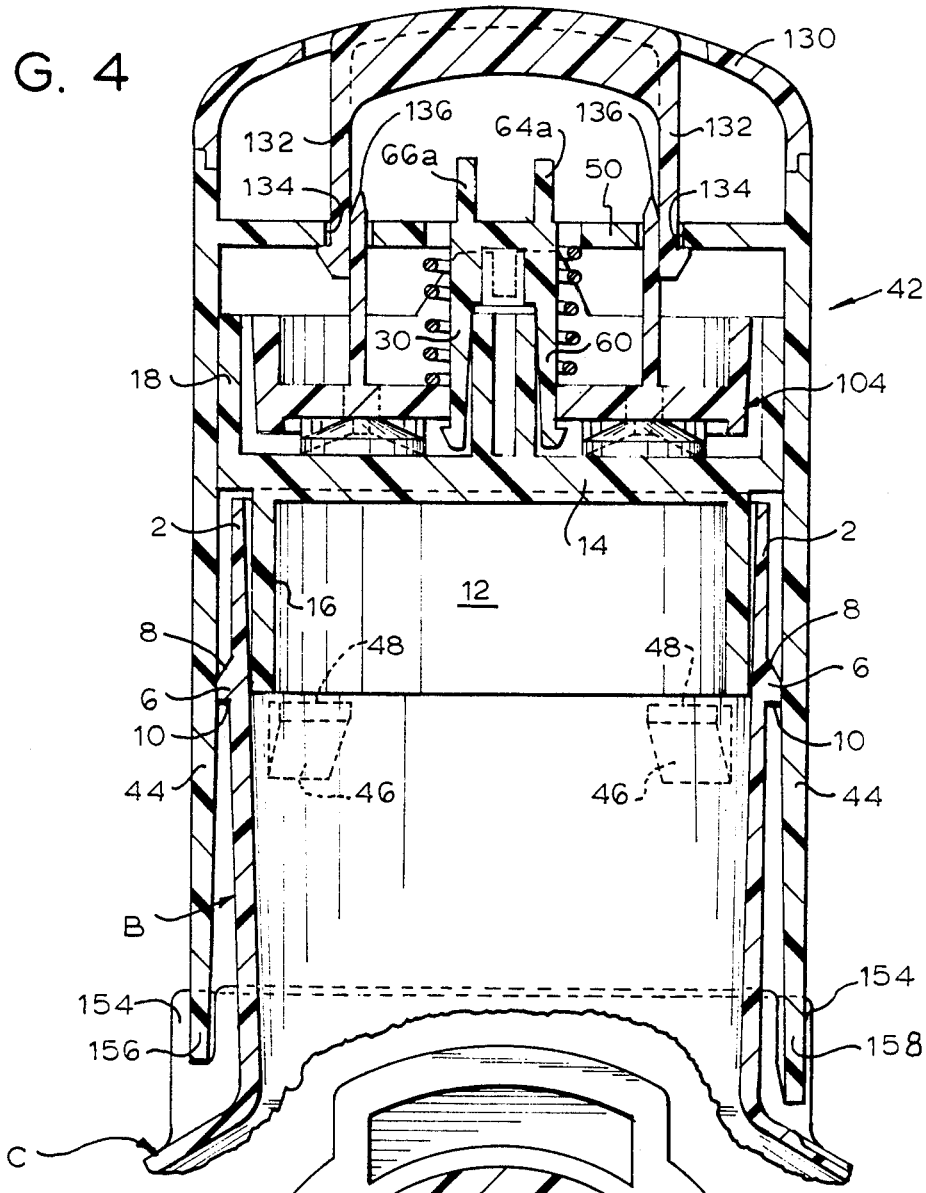
Figure 5:
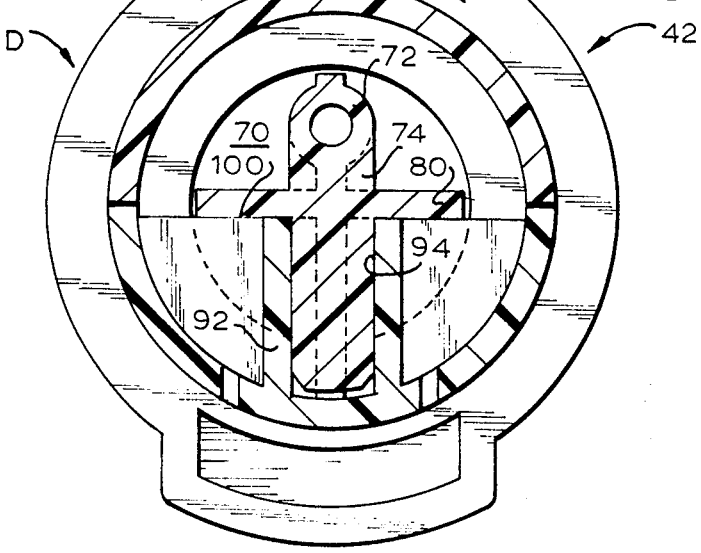
Figure 6:
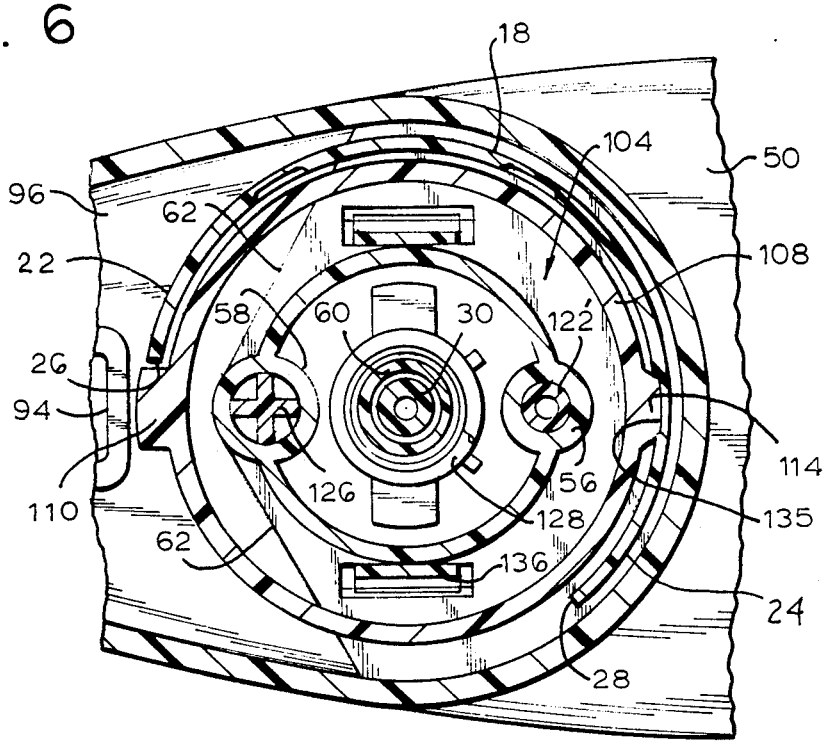
Figure 7:
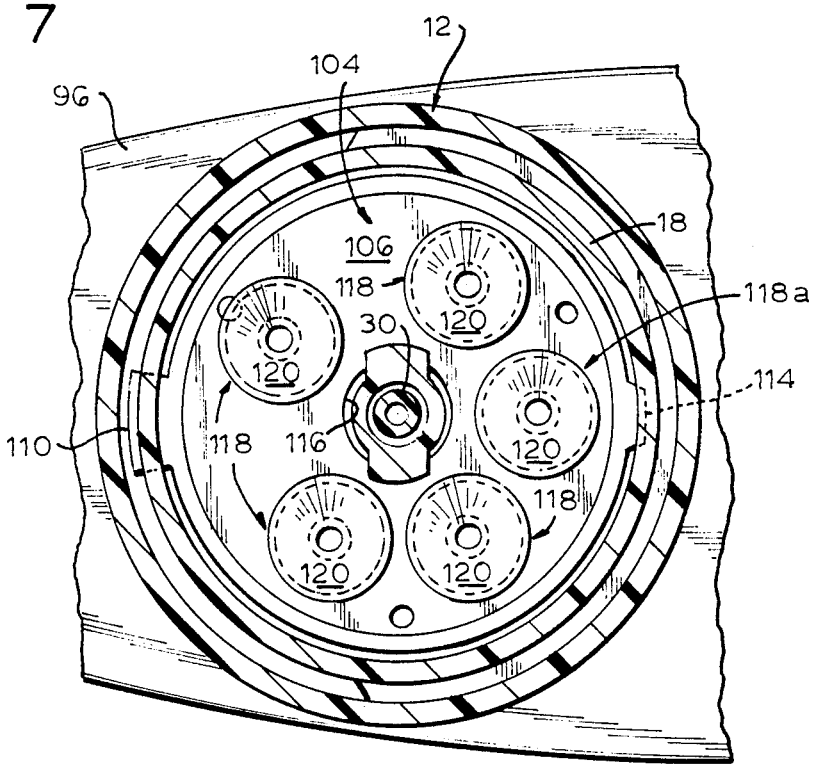
Figure 11:
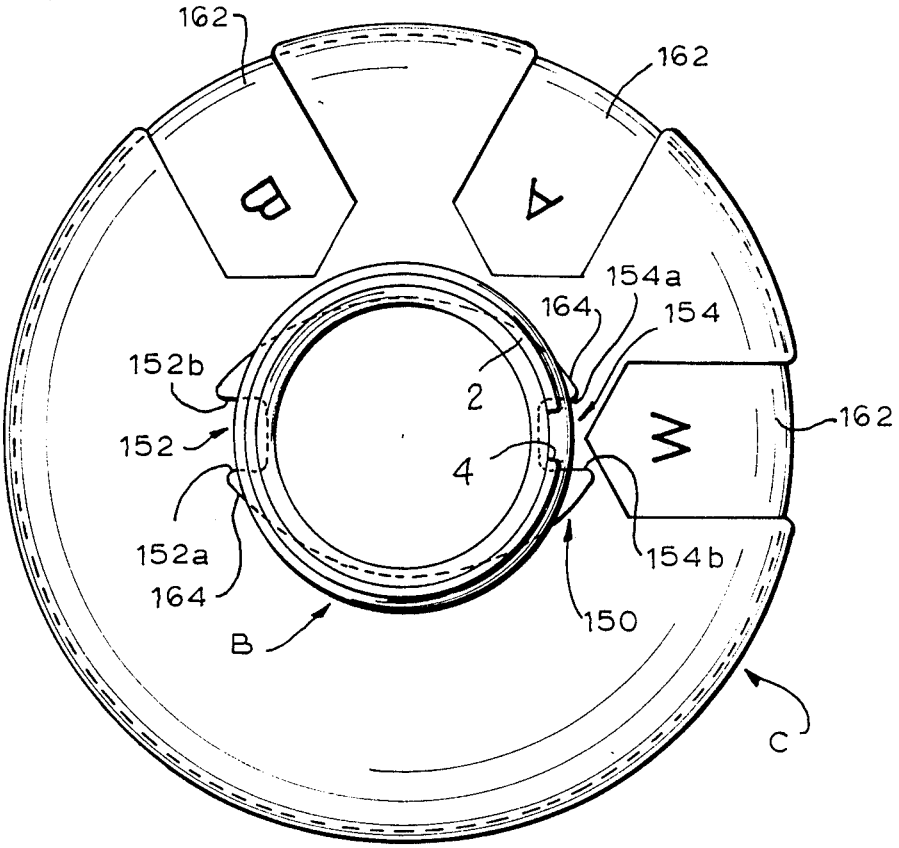
Figure 10:
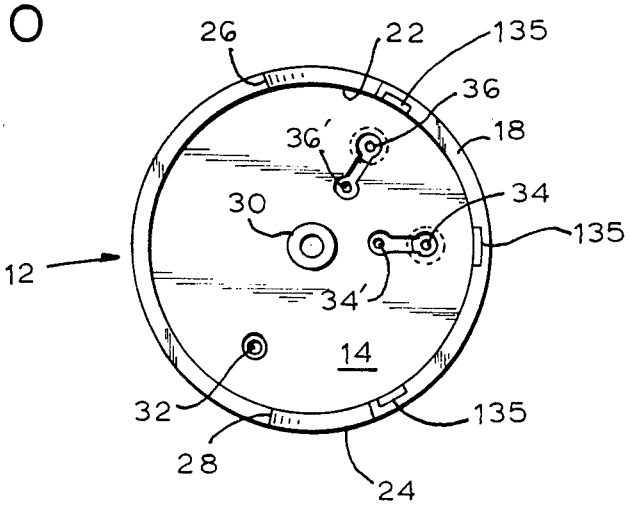

FIGS. 4, 5, 6, and 7 are cross-sectional views taken along the lines 4—4, 5—5, 6—6 and 7—7 of FIG. 3, respectively;

FIG. 8 is a front elevational view of the sprayer;

FIG. 9 is a rear elevational view thereof;

FIG. 10 is a top plan view, on a reduced scale, of the cap over which the sealing cups move; and FIG. 11 is a top plan view of the container without the sprayer.

The sprayer, generally designated A, is designed to be permanently mounted on the neck B of a container C for the material to be sprayed, such as an insecticide. The carrier fluid, in the embodiment here disclosed, is a stream of water coming from, for example, a garden hose (not shown) adapted to be secured to the sprayer by a coupling nut generally designated D.

The container C is here disclosed in the form of a jar or a bottle, the neck B of which has a thinned upper extremity 2 with a notch 4 formed at its upper edge (see FIG. 3) and with an outwardly extending circumferential ridge 6 having a downwardly and outwardly inclined upper surface 8 and a lower surface 10 defining a downwardly facing ledge.

The sprayer includes a cap generally designated 12 having a horizontal wall 14, a depending cylindrical side wall 16 and an upstanding side wall 18. The side wall 16 is designed to be snugly received inside the thinned container neck portion 2, the side wall 18 extends radially outwardly beyond the side wall 16 so as to sit on the top edge of the container neck portion 2, and a tab 20 extends down from the wall 18 and fits snugly into the notch 4 in the container neck, so that the cap 12, when put in place on the container, is not rotatable with respect to the container and seals the inside of the container neck. The upper wall 18 is provided with upstanding ears 22 and 24 having circumferentially facing edges 26 and 28 respectively. Extending up from the center of the wall 14 is a post 30. The wall 14 is provided with an aperture 32 defining an air hole and, at the same radial distance from the center of the wall 14, with apertures 34 and 36 of different sizes, and optionally with air bleed holes 34' and 36' radially inwardly located with respect to the apertures 34 and 36 respectively. Each of the apertures 34 and 36 communicates with a downwardly extending nipple 38 from which a dip tube 40 extends toward the bottom of the container C, as is conventional.

The sprayer head is generally designated 42. It comprises a cylindrical depending wall 44 provided on its inner surface with a plurality of circumferentially spaced inwardly extending lugs 46 having radially inwardly and upwardly extending surfaces terminating in axially upwardly facing ledges 48. The cylindrical wall 44 is so sized as to fit closely over the circumferential ridge 6 of the container, and when forced down to its position shown in the drawings the camming interengagement between the lugs 46 on the inside of the wall 44 and the ridge 6 on the outside of the bottle neck causes the bottle neck to contract slightly inwardly and the head wall 44 to expand slightly outwardly, especially at areas without lugs 46, until the lugs 46 snap beneath the ridge 6, after which the head 42 is permanently secured to the bottle.

The head comprises an upwardly inclined wall 50 in which an aspiration opening 52 is formed, that opening being at the bottom of a recess 54 in the upper surface of the wall 50. The aspiration opening 52 communicates with a depending tube 56. Diametrically opposed to the tube 56 is a downwardly depending tube 58 of larger diameter, and also depending from the wall 50 is an axially located tube 60. The wall 50 terminates at 62, short of the wall 44. Flanges 64 and 66 extend up from the wall 50 to either side of the aspiration opening 52 and they extend substantially the length of the wall 50 both to the left and to the right of the opening 52 as viewed in FIG. 3. The partitions 64 and 66, in the vicinity of the aspiration opening 52, extend generally parallel to one another but are tilted inwardly toward one another, whereas the partition portions **64*a* and 66*a* located well to the left of the aspiration opening 52** are generally vertical but diverge from one another in the leftward direction.

A nozzle unit generally designated 68 comprises a vertical rear wall 70 from which a short tubular nozzle portion 72 extends, and resilient fingers 74 project downwardly from the nozzle part 72. A flange 76 extends down from the nozzle portion 72 forwardly of the fingers 74, and it carries a forwardly projecting tab 78 adjacent its lower end. The wall 70 has a horizontal wall 80 projecting forwardly therefrom. The nozzle 68 is received within the coupling nut D, its nozzle portion 72 extending through the central opening 82 of the coupling nut D. A valve washer 84 of rubbery or plastic material is received within the coupling nut D and has radially outwardly extending lugs 86 and 86' of different width received in corresponding interruptions 88 and 88' in the internal threading 90 of the coupling nut D, the washer 84 retaining the coupling nut D and nozzle unit 68 assembled with one another and at the same time rotating with the coupling nut D. The washer 84 is provided with a pair of through apertures 92 designed, when the washer 84 rotates with the coupling nut D, to move into and out of registration with the nozzle part 72. This assembly is mounted on the head 44 by inserting the spring fingers 74 into a vertical passage 94 in a rearwardly extending portion 96 of the head 42, the fingers 74 then snapping into place beneath ledges 98 formed on the interior of the passage 94. When in this position the horizontal wall 80 rests on the upper edge 100 and the portion 76 engages between ledges 102, so that the output end of the nozzle portion 72 points directly toward the space between the flange portion **64*a* and 66*a***.

When the head 42 is moved to its permanently attached position, the upstanding tube 30 on the cap 12 is received within the central tube 60 depending from the wall 50.

Interposed between the head 42 and the cap 12 is a cup carrier generally designated 104 and comprising a bottom wall 106 and a side wall 108 having a tab 110 radially extending therefrom and an upwardly extending portion 112 with a notch 113 and an outwardly extending lug 114 diametrically opposite the tab 110. The wall 106 is centrally apertured at 116, to freely receive the tube 60 depending from the head wall 50, and it is further provided with a plurality of appropriately positioned apertures, here shown as five in number, for receiving an equal number of depending sealing cups 118. Four of those cups define blind downwardly-opening cupped portions 120 with central solid shafts 122 extending thereabove and received in the aforementioned openings. The fifth cup **118*a* is similar to the other cups except that the portion 122' extending up therefrom through an opening in the wall 106 is in the form of an open tube which communicates with the interior of the cap 118A. Preferably all of the cups 118 have integrally formed therewith, around the rim of the cup, upwardly extending teeth 124 which engage the underside of the wall 106. The cups 118 are formed of any suitable pliant material. Extending up from the wall 106 diametrically opposite the open tube 122' is a cross-shaped tab 126 snugly received within the tube 58 depending from the head wall 50. A spring 128 surrounds the tube 60 depending from the head wall 50 and is compressed between the head wall 50 and the cup carrier wall 106, thus urging the cup carrier 104 downwardly and pressing the cups 118 and 118A into sealing engagement with the upper surface of the cap wall 14. The cups are located radially to the same extent as the openings 32, 34 and 36 in the cap wall 14**.

A cover shell 130 secured in place by depending fingers 132 which snap beneath openings 134 in the head wall 50. Tabs 136 may extend upwardly from the cup carrier 104 so as to pass through the openings 134 inside the spring fingers 132, thus inhibiting movement of the spring fingers 132 to disengaging position. Tabs 136 may extend up from the wall 50 to support the shell 130.

The engagements between the tab 126 extending up from the cup carrier 104 and the tube 58 extending down from the head wall 50 and the engagement of a rib 138 depending from head 42 and received in notch 113 ensure that the cup carrier 104 rotates with the head 42 when the latter is turned, that rotation being permitted and limited by movement of the tab 110 on the cup carrier 104 and the tab 78 on the nozzle unit 68 within the circumferential arc defined between the cap ledges 26 and 28. The cups 118 are so located on the cup carrier 104 that when the sprayer head 42 and the cup carrier 104 are in one extreme position one of the blind cups 118 will be sealingly positioned over the top of the air hole 32 and two others of the blind cups 118 will be positioned over the tops of the holes 34 and 36 (and 34' and 36' if present). The spring 128 will press the cup carrier 104 downwardly and thus ensure that the cups 118 make a proper seal with the upper surface of the cap wall 14. The teeth 124 on each cup 118 further exert force from the spring 128 to assure the seal. This will seal the interior of the container, and prevent any of the container contents from coming out. If water is passed through the sprayer it will exit without any aspiration taking place.

If the sprayer head A is now rotated to a second position, with the tabs 110 and 78 at the other extremity of the arc between the stop surfaces 26 and 28, the cups will be positioned so that the air hole 32 is exposed, one of the sets of openings 34, 34' will be sealed by a blind cup 118, and the other of the set of openings 36, 36' will be sealed by the cup 118A which communicates with the open tube 122', thus placing the holes 36, 36' in communication with the aspiration opening 52. Then as carrier fluid moves through the nozzle 72, onto the wall 50 between the flanges 64 and over the aspiration opening 52, aspiration will take place at a predetermined rate as dictated by the size of the opening 36. Because the air hole 32 is exposed, air is permitted to enter the container as contents are sucked therefrom, so that aspiration continues at the desired rate.

If the sprayer head A is rotated to an intermediate position the air hole 32 is again exposed, the holes 36, 36' are sealingly engaged by a blind cup 118, and the holes 34, 34' are sealingly engaged by the cup **118*a* which communicates with the open tube 122', so that now aspiration will occur at a different rate, as determined by the relative sizes of the openings 34 and 36**.

Detent positioning of the head 42 in its aspiration positions is achieved by the action between the lug 114 on the outside of the cup carrier 104 and detenting recesses 135 on the inner surface of the cap wall 18.

It is important for safety reasons that when the sprayer head 42 is in its no-aspiration or sealed position it be retained in that position in such a way as to prevent movement therefrom accidentally or through the action of an inquisitive child. To that end cooperative means are provided on the head 42 and the container C which prevent or inhibit rotation of the head 42 unless the head 42 is specially manipulated in a fashion which would not occur accidentally or if a child attempted to turn the head 42. In the form here specifically disclosed that safety function is accomplished by providing on the container neck B spaced below the ledge 10 a radial enlargement generally designated 150 formed with a pair of diametrically opposed notches 152 and 154 open at the top, those notches being defined by relatively short side walls **152*a*, 154*a* and relatively long side walls 152*b* and 154*b* respectively, the short side walls 152*a* and 154*a* being on the counterclockwise sides of the notches 152 and 154 respectively as viewed in FIG. 11. The neck diameter of the bottle C as it extends below the ledge 10 is gradually decreased, thereby to produce an appreciable radial clearance between the inner surface of the wall 44 and the outer surface of the container neck B, and a pair of diametrically opposed tabs 156 and 158 of a size such as to be received in the notches 152, 154 respectively project downwardly from the wall 44. At positions 90° disposed from the tabs 156 and 158 the wall 44 below the lugs 46 is provided with finger-receiving portions 160 visually identified by a series of grooves. The upper surface of the container C is provided with index marks 162, here shown to be three in number and designated W, A and B, designed to register with any appropriate index mark such as tab 158 on the exterior of the lower portion of the head wall 44**.

When the sprayer is in its no-aspiration or sealed rotative position the index mark or tab 158 on the sprayer will register with the "W" index mark 162 (signifying "water only") and the tabs 156 and 158 will be received within the notches 152 and 154, thus preventing rotation of the head 42. Any attempt by a child, or any accidental force tending to rotate the head 42 will therefore be frustrated. However, if the finger-receiving portions 160 are pressed radially inwardly, such movement being permitted by the clearance between the lower portion of the wall 44 and the container neck B, those portions of the wall 44 90° removed from the finger-receiving portions 160 will, because of the thinness of the wall 44, flex sufficiently to move the tabs 156 and 158 radially outwardly by a distance greater than the height of the notch walls 152*a*, 154*a* but less than the height of the notch walls 152*b* and 154*b*. This will enable the head 42 to be rotated in one direction but not in the other until the indicator carried thereby comes opposite either the "A" or "B" index mark 162 on the container, thus conditioning the sprayer for aspiration to one or another preset degree. When the head 42 is rotated in the opposite direction, that rotation will be permitted, the tabs 156 and 158 riding over the cam surfaces 164 leading to the notches 152, 154, until those tabs 156 and 158 snap back into the notches 152, 154, thereby retaining the head 42 in its container-sealing position until the finger-receiving portions 160 are once again pressed radially inwardly. Hence movement of the head 42 out of its container-sealing position requires a sophisticated and non-obvious type of manipulation which will maintain the integrity of the container C and its contents against carelessness or the actions of children.

Since the washer 84 rotates with the coupling nut D, while the nozzle 72 remains stationary, the washer 84 functions as an on-off valve for flow of the carrier fluid when a hose is attached to the coupling nut D. When the washer 84 has one or the other of its apertures 92 registering with the nozzle 72 carrier fluid will flow through the nozzle 72, but when the coupling nut is rotated 90° from that position neither of the openings 92 will register with the nozzle 72, and hence there will be no flow of carrier fluid.

All of the parts may conveniently be molded from plastic material and thus are relatively inexpensive, they can be readily assembled, and hence the cost of the sprayer unit can be made consistent with use with but a single container. Sealing of the container when not in use is effectively attained. The spring 128 urges the cup seals 118 into sealing engagement with the openings in the cap wall 14. Although open-gap aspiration is employed, thus minimizing cost, means have been provided to produce a much stronger, longer spray, amounting to some 35 feet, than has been previously accomplished with sprays of this type.

While but a single embodiment of the present invention has been here specifically disclosed, it will be apparent that many variations may be made therein, both as to specific structure and manner of functioning, all within the spirit of the invention as defined in the following claims.

We claim:

1. A chemical sprayer comprising a container for the chemical to be sprayed, an aspiration assembly comprising a structure having as asiration means adapted to communicate with the interior of said container and means for guiding a flow of fluid over said aspiration means and out, from said structure, and means for non-removably and rotatably mounting and securing said assembly on said container.

2. The chemical sprayer of claim 1, in which said securing means comprises a first part substantially fixedly connected to said container, a second part movable with said aspiration assembly, and mounting means for mounting said second part on said first part for movement with said aspiration assembly between first and second positions respectively sealingly interrupting and effecting the communication between said aspiration means and the interior of said container.

3. The sprayer of claim 2, in which said means for mounting said second part on said first part provides for movement of said second part in a given direction from said first position to said second position only after relative movement between said first and second parts in a direction other than said given direction, and means for preventing movement of said second part from said first position in a direction opposite to said given direction.

4. The sprayer of claim 3, in which said means for mounting said second part on said first part and for preventing movement of said second part from said first position in a direction opposite to said given direction comprises said first part having a substantially radially opening recess with an outwardly facing high side and an outwardly facing low side, said second part carrying an element normally received in said recess when said second part is in said first position, said element being movable radially outwardly a distance sufficient to clear said outwardly facing low side but not to clear said outwardly facing high side when said second part is to be rotated toward said second position.

5. The chemical sprayer of claim 2, in which said container has an open neck, said first part comprises a tubular section non-rotatably and permanently mounted on said neck, and said second part comprises a tubular section received over and rotatable with respect to said first part.

6. In a chemical sprayer comprising a wall adapted to be mounted on a container and having an aspiration means adapted to communicate with the interior of said container, and means for guiding a flow of fluid over said aspiration means and to an output point, the improvement which comprises said guiding means comprising nozzle means for directing said fluid flow in a relatively narrow stream, flanges extending up from said wall to either side of said aspiration means downstream of said nozzle and extending between points downstream and upstream of said aspiration means, the spaces between said flanges being in line with said nozzle, said flanges being inclined upwardly and inwardly toward one another in the vicinity of said aspiration means and the space between said aspiration means and said flanges being non-confining with respect to said fluid, thereby to produce a jet-like stream of fluid from said sprayer.

7. The sprayer of claim 6, in which there is a gap between the upper portions of said flanges in the vicinity of said aspiration means.

8. The sprayer of either of claim 6 or 7, in which said flanges extend lengthwise approaching one another from said nozzle toward said aspiration means and extend lengthwise diverging from one another from said means toward said output point.

9. The sprayer of either of claim 6 or 7, in which said flanges extend lengthwise approaching one another and then diverging from one another from said nozzle toward said aspiration means and diverge from one another to a greater degree from said means toward said output point.

10. In a chemical sprayer comprising a first wall adapted to be mounted on a container and having an aspiration means adapted to communicate with the interior of said container, and means for guiding a flow of fluid past said aspiration means and to an output point, the improvement which comprises a second wall below said first wall and having a first aperture therethrough adapted to communicate with the interior of said container, a carrier movably mounted above said second wall and carrying a resilient first sealing element depending from its underside which resiliently sealingly engages said second wall, fluid-conveying means between the interior of said first sealing element and said aspiration means, and means for moving said carrier between first and second operative positions in which said sealing element is positioned respectively in and out of fluid communication with said aperture.

11. In a chemical sprayer comprising a first wall adapted to be mounted on a container and having an aspiration means adapted to communicate with the interior of said container, and means for guiding a flow of fluid past said aspiration means and to an output point, the improvement which comprises a second wall below said first wall and having a first aperture therethrough adapted to communicate with the interior of said container, a carrier movably mounted above said second wall and carrying a first sealing element on its underside which sealingly engages said second wall, fluid-conveying means between the interior of said first sealing element and said aspiration means, and means for moving said carrier between first and second operative positions in which said sealing element is positioned respectively in and out of fluid communication with said aperature, in which said second wall has a second aperture therethrough adapted to communicate with the interior of said container, said carrier carrying second and third sealing elements one its underside which sealingly engage said second wall to define closed internal spaces, said second and third sealing elements being so located on said carrier as to be positioned with their internal spaces respectively out of and in fluid communication with said first and second apertures when said carrier is in its first and second operative positions respectively.

12. The chemical sprayer of claim 11 in which said second wall has a third aperture therethrough adapted to communicate with the interior of said container, said carrier carrying one or more additional sealing elements on its underside which sealingly engage said second wall to define a closed internal space, said carrier-moving means being effective to move said carrier between said first, second and third operative positions, the first operative position of said carrier bringing said first sealing element into fluid communication with said first aperture and all other sealing elements out of fluid communication with said second aperture, the second operative position of said carrier bringing said first sealing element into fluid communication with said third aperture and all of the other of said sealing elements out of communication with said second aperture, the third operative position of said carrier bringing said second and additional sealing elements into fluid communication with said first, second and third apertures.

13. The chemical sprayer of any of claims 10, 11 or 12, in which said first wall and said carrier are operatively connected for movement togther when said carrier is moved between its operative positions.

14. The chemical sprayer of any of claims 10, 11 or 12, in which said first wall and said carrier are operatively connected for movement together when said carrier is moved between its operative positions and in which said carrier is resiliently urged toward said second wall, thereby to secure sealing engagement of said sealing elements with said second wall.

15. The chemical sprayer of any of claims 10, 11 or 12, in which said carrier is resiliently urged toward said second wall, thereby to ensure sealing engagement of said sealing elements with said second wall.

16. The chemical sprayer of any of claims 10, 11 or 12, in which said carrier is rotatably movable above said second wall and carries a dummy element circumferentially located between two of the sealing elements, said dummy element engaging said second wall to balance said carrier.

17. The chemical sprayer of any of claims 10, 11 or 12, in which said sealing element extends below said carrier and is provided adjacent its periphery with upstanding resilient parts which engage the undersurface of said carrier and press said sealing element against said second wall, thereby to ensure good sealing engagement between said sealing element and said second wall.

18. The chemical sprayer of any of claims 10, 11 or 12, in which said first wall and said carrier are mounted as a unit to be rotatable relative to said container and said second wall is mounted to be non-rotatable relative to said container.

19. The chemical sprayer of any of claims 10, 11 or 12, in which said container is provided with an open neck, said second wall is part of a structure telescopically mounted on said container neck, said first wall is part of a structure telescopically and rotatably mounted on said second wall structure, and said carrier is connected to said first wall structure for rotation therewith when said carrier is moved between its operative positions.

20. The chemical sprayer of any of claims 10, 11 or 12, in which the fluid-conveying means between the interior of said first sealing element and said aspiration means comprises a tube extending from said first sealing element, passing through said carrier and extending above said carrier, said tube being received within fluid-conveying means on said first wall.

21. The chemical sprayer of any of claims 10, 11 or 12, in which said first wall and said carrier are operatively connected for movement together when said carrier is moved between its operative positions by connection means comprising a part extending up from said carrier and received within receptacle means on the underside of said first wall.

22. The chemical sprayer of claim 21, in which said connection means between said first wall and said carrier further comprises a second part extending up from said carrier at a point substantially circumferentially spaced form said first-mentioned part and received within correspondingly located second receptacle means on the underside of said first wall.

23. A chemical sprayer adapted to be mounted on the neck of a container, said neck having an axis, said sprayer comprising a part having an aspiration means adapted to communicate with the interior of said container and having means for guiding a flow of fluid past said aspiration means and to an output point, said part being rotatably mounted on said container neck for rotation substantially coaxially with said neck axis, and means for establishing and interrupting fluid flow between said aspiration means and the interior of said container, said means being secured to and movable with said part so that said rotation of said part with respect to the neck of said container controls the aspiration effect.

24. A chemical sprayer adapted to be mounted on the neck of a container said sprayer comprising an exposed wall having an open-gap aspiration means adapted to communicate with the interior of said container and having means for guiding a flow of fluid past said aspiration means to an outlet point, a cover comprising wall means substantially covering said exposed wall to define therebetween an open-end space which does not interfere with said fluid flow nor with the open-gap nature of said aspiration means, and means for releasably engaging said cover with said exposed wall, in which said cover comprises an arched wall having lower edges, and said releasably engaging means comprises spring fingers depending from said arched wall which are snap-received in apertures in said exposed wall when said lower edges of said arched wall engage said exposed wall.

25. A chemical sprayer adapted to be mounted on the neck of a container said sprayer comprising an exposed wall having an aspiration means adapted to communicate with the interior of said container and having means for guiding a flow of fluid emanating from a nozzle past said aspiration means to an output point, and a nozzle unit mounted on said wall and directed toward said guiding means, said nozzle having depending spring fingers and said wall having apertures into which said fingers are adapted to be received, there to engage said wall with a snap action to retain said nozzle on said wall, in which said spring fingers, when in said apertures, are accessible from the underside of said wall, thereby to enable said nozzle to be disassembled from said wall.

26. The sprayer of claim 25, in which said nozzle comprises an axially extending body with a fluid passage therethrough, said spring fingers depending from a forward portion of said body, said body having a radially enlarged flange-like portion at its rearward end, and a coupling nut having a side wall, open at one end and partially closed at the other end by an end wall, said flange-like portion of said nozzle being received inside said coupling nut and engaging said end wall with the body of said nozzle passing through said end wall, said coupling nut being rotatable with respect to said nozzle, and a valve member received within and rotating with said coupling nut and having a fluid passage opening which, as said coupling nut is rotated, moves into and out of fluid communication with said fluid passage in said nozzle.

27. The sprayer of claim 25, in which said nozzle comprises an axially extending body with a fluid passage therethrough, said spring fingers depending from a forward portion of said body, said body having a radially enlarged flange-like portion at its rearward end, and a coupling nut having a side wall, open at one end and partially closed at the other end by an end wall, said flange-like portion of said nozzle being received inside said coupling nut and engaging said end wall with the body of said nozzle passing through said end wall, said coupling nut being rotatable with respect to said nozzle, and a valve member received within and rotating with said coupling nut and having a fluid passage opening which, as said coupling nut is rotated, moves into and out of fluid communication with said fluid passage in said nozzle, said valve member engaging the interior of said coupling nut to define means for retaining said coupling nut on said nozzle.

28. A chemical sprayer for use with a garden hose comprising a container for the chemical to be sprayed, a spray head comprising means for attaching a garden hose thereto, means for guiding fluid from said hose through said head to an outlet for said hose fluid and aspiration means operatively associated with said guiding means and communicating with the interior of said container when said head is mounted thereon, and cooperating means on said container and said head for non-removably mounting and securing said head on said container.

* * * * *